US005513842A

United States Patent [19]

Fuss

[11] Patent Number: 5,513,842

[45] Date of Patent: May 7, 1996

[54] GOLF SWING TRAINING AID

[76] Inventor: Christopher A. Fuss, 2415 Midway Blvd., Wausau, Wis. 54401

[21] Appl. No.: 315,559

[22] Filed: Sep. 30, 1994

[51] Int. Cl.[6] ..... A63B 69/36

[52] U.S. Cl. ..... 473/263; 473/265; 473/148

[58] Field of Search ..... 273/35 R, 185 C, 273/185 D, 186.1, 184 B, 200 R, 200 B, 208, 26 E, 197 A

[56] References Cited

U.S. PATENT DOCUMENTS 1,732,971 10/1929 Kappeler ..... 273/35 R
1,940,033 12/1933 Von Schlegell ..... 273/185 C
3,851,886 12/1974 Acosta ..... 273/184 B
4,175,744 11/1979 Llewellyn ..... 273/26 E
4,664,375 5/1987 Tetreault ..... 273/26 E

*Primary Examiner*—V. Millin
*Assistant Examiner*—William M. Pierce
*Attorney, Agent, or Firm*—Ryan, Maki, Mann & Hohenfeldt

[57] ABSTRACT

A golf swing practice device for assisting a golfer in the development of a correct golf swing includes a flat support base, an upright supporting member extending upwardly from a surface of the base, and a bracket vertically adjustably mounted on the upright member. An arm extends laterally and is angularly adjustably mounted on the bracket. At least one, and preferably several pendulum members are suspended on the arm to serve as indicators that a practice golf swing did not travel in an optimum intended swing path.

7 Claims, 3 Drawing Sheets

GOLF SWING TRAINING AID

FIELD OF THE INVENTION

The present invention relates to a golf swing training aid and more particularly to such a device which assists a golfer in developing a swing that travels through a golf ball for a correct impact and direction.

BACKGROUND OF THE INVENTION

Various practice aids have been developed to assist golfers in developing a correct golf swing. In addition to videotapes demonstrating a correct swing, various mechanical devices have been developed. Some of these devices entail attachments to a club to ensure that it is properly held and moved through the swing. Other devices have been placed on the ground to give the golfer a point of reference as he swings or to prevent the golf club from moving on an incorrect path. Examples of such devices are seen in U.S. Pat. No. 4,659,084, issued to Vuick on Apr. 21, 1987, and U.S. Pat. No. 5,263,719, issued to Bunn on Nov. 23, 1993. Other training devices have required a mechanism to act as a replacement for a golf club. See, for example, U.S. Pat. No. 5,301,948, issued to Hundley on Apr. 12, 1994.

Although these various devices have proved helpful in some cases, a need has continued to exist for a simple, inexpensive device which will assist a golfer, using his own golf clubs, to develop a proper swing.

SUMMARY OF THE INVENTION

It is a primary object of the present invention to provide a training device which assists a golfer in developing a proper swing by providing an opening for swinging of the club as it passes through the ball contact zone.

It is a further object of the invention to provide a device which is adjustable so that an opening in the ball contact zone is custom fitted for clubs of varying size and loft. In accordance with a related aspect of the invention, the device of this invention can be adjusted to match the heel-to-toe horizontal angle of the top of the club head. In accordance with a still further aspect of the invention, the device of this invention is adjustable so as provide a larger or smaller window or opening to drive the club head through. This enables the golfer to increase the accuracy of the swing as he has worked with the device over a period of time.

In accordance with a further aspect of the invention, a series of movable weights or pendulums is provided which indicate to the golfer the location of the club swing path that is incorrectly traversed during the course of a practice swing. In accordance with still another aspect of the invention, the bottom end of the weight or pendulum can be varied to provide different profiles for the desired swing motion. In this regard a simpler device may include a series of weights or pendulums having spherical balls on their bottom ends for providing guidance to the golfer. A variation would include transversely elongated bottom elements such that the overall shape of each pendulum is in the appearance of a hammer. This embodiment provides a means to ensure that the golf swing remains in a lengthened flattened travel path through the ball contact zone.

Briefly, a golf swing practice device is provided for assisting a golfer in the development of a correct golf swing, which device includes a flat support base, an upright supporting member extending upwardly from a surface of the base, and a bracket vertically adjustably mounted on the upright member. An arm extends laterally and is angularly adjustably mounted on the bracket. At least one, and preferably several pendulum members are suspended on the arm to serve as indicators that a practice golf swing did not travel in an optimum intended swing path.

Further objects and advantages of the invention will become apparent from the following detailed description, the appended claims and the accompanying drawings.

DESCRIPTION OF PREFERRED EMBODIMENTS

Figure 1:
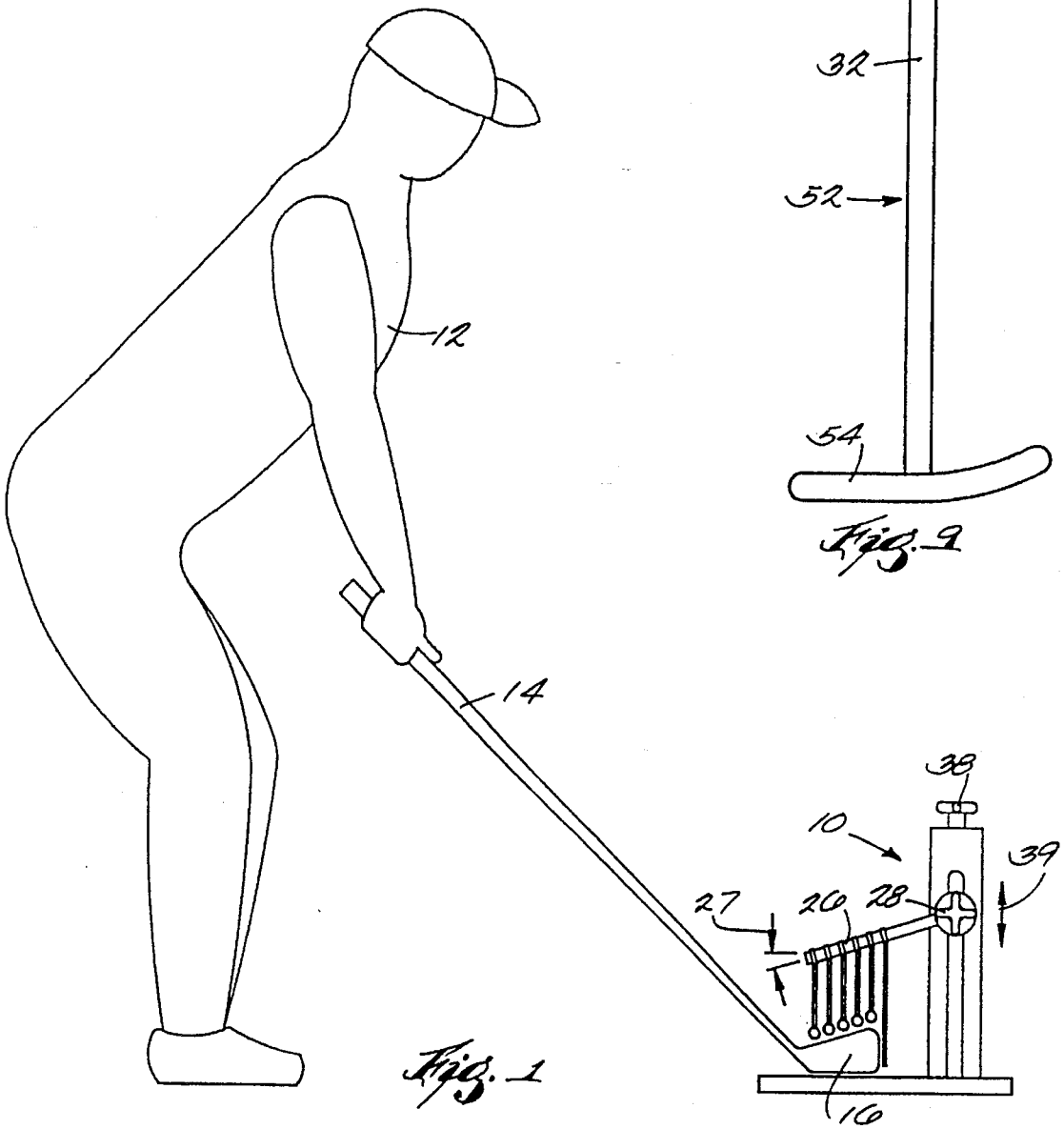
FIG. 1 is a side elevational view of a device of this invention showing a golfer with golf club addressing the device.

Referring more particularly to the drawings, there is seen a golf swing practice aid device of the present invention generally indicated by numeral 10. As seen in FIG. 1, device 10 is addressed by a golfer 12 holding a club shaft 14 and placing club head 16 into the device. The golfer is, thus, able to address the device much in the manner in which he would address a golf ball.

Figure 2:
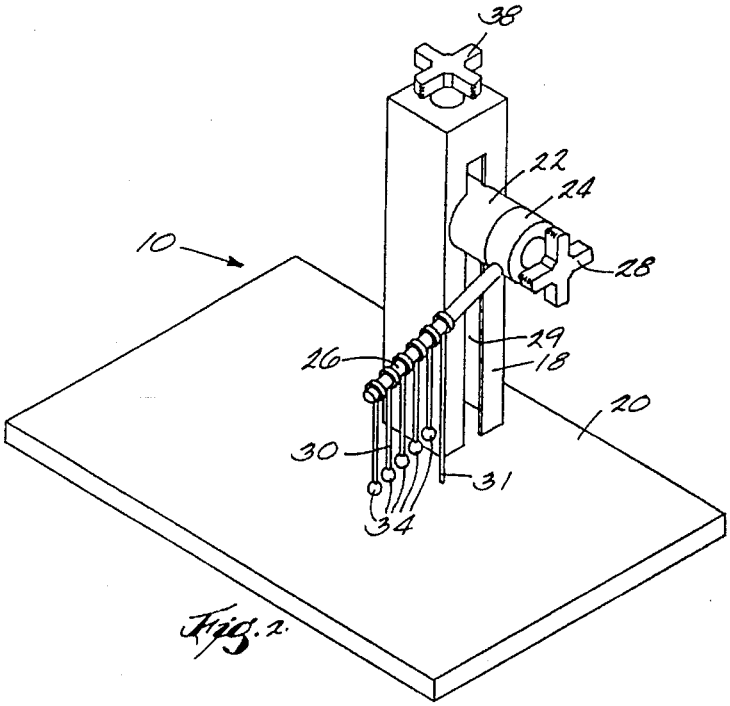
FIG. 2 is an isometric view of one embodiment of a device in accordance with the invention.
Figure 8:
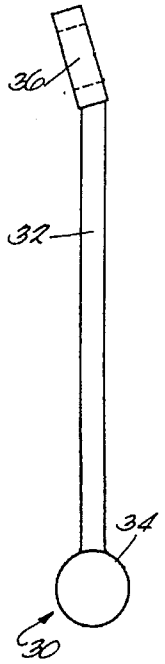
FIG. 8 is a side elevational view of one of the weights of the device of FIG. 2.
Figure 3:
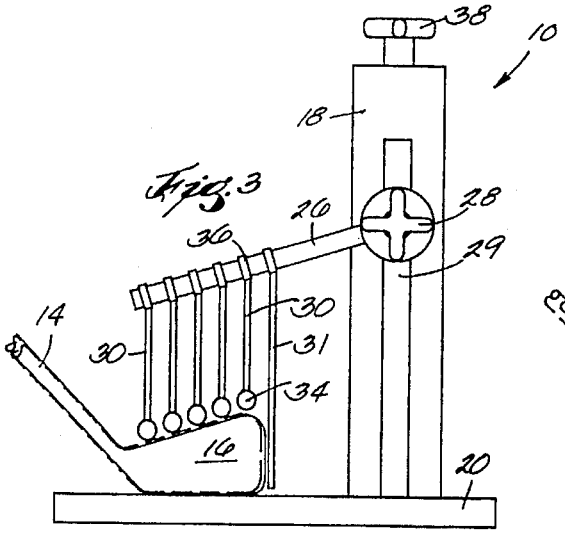
FIG. 3 is a fragmentary side elevational view illustrating a golf club placed in the ball contact area of a device of FIG. 2.
Figure 4:
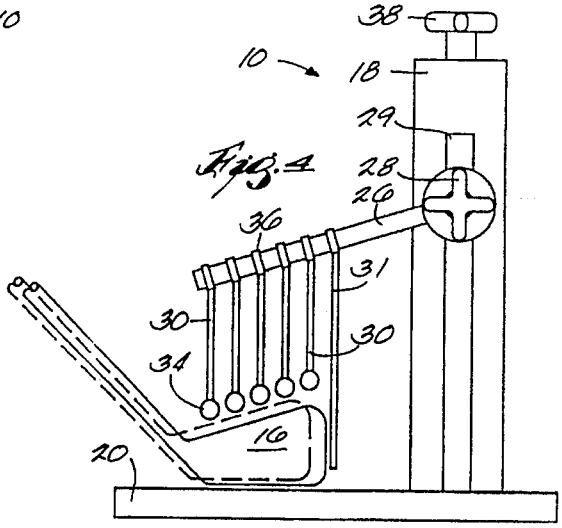
FIG. 4 is a side elevational view of the device of FIG. 3 adjusted upward to allow a greater degree of tolerance for passage therethrough of a golf club and showing alternate positions of the golf club by means of phantom lines.
Figure 5:
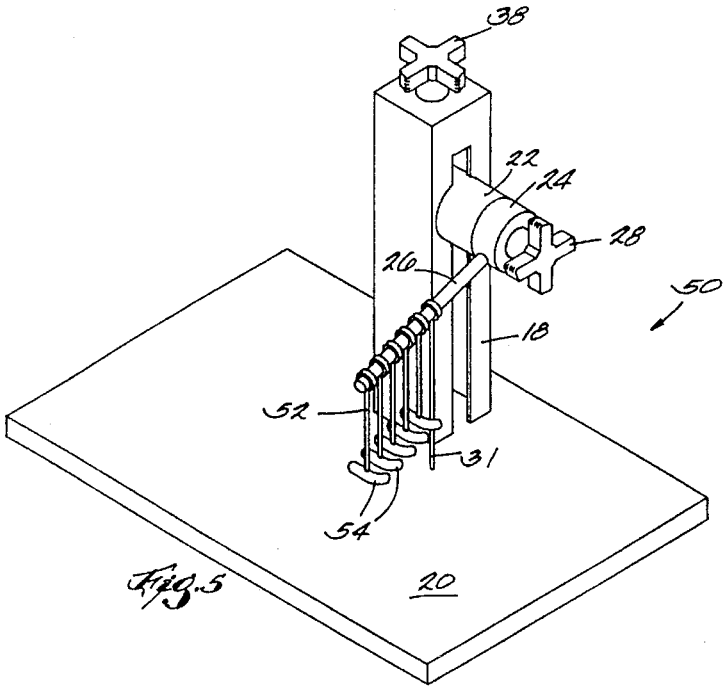
FIG. 5 is a isometric view of a device formed in accordance with an alternative embodiment of the invention.
Figure 6:
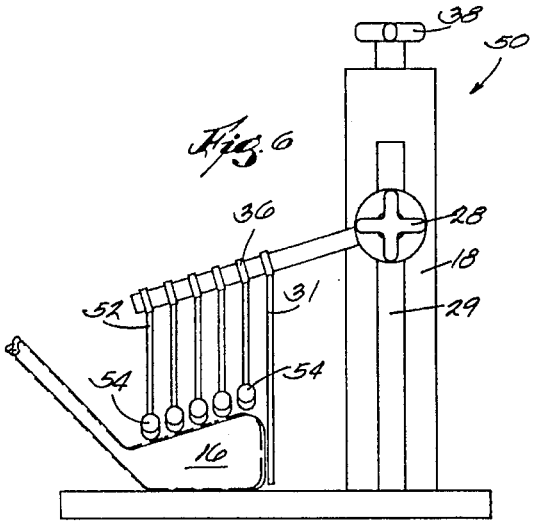
FIG. 6 is a side elevational view of the device of FIG. 5 showing a fragmentary golf club in conjunction therewith.
Figure 7:
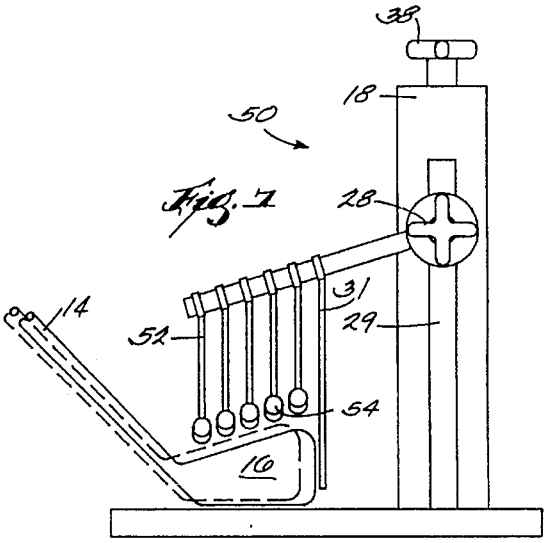
FIG. 7 is a side elevational view of the device of FIG. 5 adjusted for a greater degree of tolerance for passage of a golf club therethrough with an alternative position of a golf club shown by means of phantom lines.

Referring to FIGS. 2–4, it will be noted that device 10 includes an upright hollow support member 18 secured to a flat base member 20. An annular adjustment member 22 is slidably mounted in a slot 29 in upright support member 18. Another annular bracket 24 supports an arm 26. Bracket 24 may be provided with serrated teeth interfitting with mating teeth on member 22 so that arm 26 is, thus, angularly adjustable by means of a threaded clamping member 28 which includes a shaft threaded into annular member 22 or vice-versa. Alternatively, a serrated washer can be used between members 22 and 24 to provide for such adjustment. Adjustment member 22 is vertically adjustable by means of threaded element 38 which includes a threaded shaft mounted in a threaded socket provided in the body of bracket 22. Bracket 22 is, thus, adjustable upwardly and downwardly in slot 29.

Arm 26 supports a plurality of suspended pendulum members 30. Pendulums 30 include an elongated shaft on the lower end of which is suspended a ball 34 and an eyelet 36 on its upper end intended for mounting on shaft 26. Pendulums 30 are preferably formed from a molded plastic material so as to minimize any damage to club head 16. Also, suspended on arm 26 is a straight pendulum member 31 having a length greater than that of pendulums 30. Member 31 provides to the golfer an indication, if struck, that the club has been extended to far so that the toe of the club has inadvertently struck member 31.

Referring to FIGS. 1, 3 and 4, it is seen that arm 26 can be adjusted so that its angle 27 from the horizontal is approximately equal to that defined by the top surface of club head 16. As seen in FIG. 3, arm 26 can also be raised or lowered so that ball elements 34 are nearly in contact with the top of the club head and the angle of arm 26 adjusted by means of knob 28. The degree of tolerance between balls 34 and club head 16 can then be adjusted as seen in FIG. 4 by raising hollow support bracket 22 utilizing knob 38. In beginning to practice with the device, it may be preferable to allow a reasonable degree of tolerance between pendulum head balls 34 and club head 16 as seen by the phantom lines in FIG. 4. Then, as the golfer improves his accuracy in utilizing the device, arm 26 can be lowered to require that a greater degree of accuracy is needed to swing the club head 16 under the row of pendulum head balls 34. The golfer can reset the opening as he changes clubs so that a properly sized opening is provided for each club of variable club head pitch.

In order to facilitate adjustment and to better view the opening available between the row of pendulum head balls 34 and club head 16, it is preferable to use a small mirror in order to simplify the process. Then, after the opening has been adjusted, the golfer, after making a back swing for a golf shot being practiced, can attempt to swing the club head through the opening in device 10 as it normally would be driven through a ball during play on a golf course. Any movement of the pendulums would indicated that the club head did not pass cleanly through the opening, as adjusted, and that a miss hit would have occurred, had the golfer been striking a golf ball. When the golfer is able to consistently and repeatedly drive the club head through the opening without disturbing the pendulums, he can reduce the size of the opening to increase the challenge required and further improve his golf swing, thereby improving his skill level.

Figure 9:
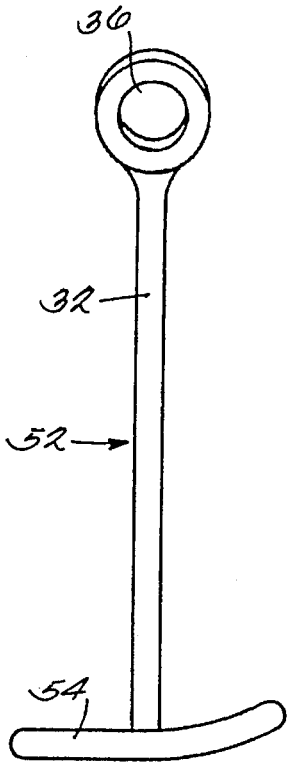
FIG. 9 is a front elevational view of one of the weights used in conjunction with the device of FIG. 5.

Referring to FIGS. 5–7 and 9, there is seen a modified device 50 representing a further embodiment of the invention. In the case of device 50, each pendulum component 52 as best seen in FIG. 9 is provided with an elongated lower cross member 54 which gives pendulum component 52 the shape of an inverted hammer. The pendulums 52 are utilized in the same manner as described for pendulum members 30. Thus, the foregoing description applies equally well to embodiment 50 of the device. The modified embodiment 50 provides a training device wherein the desirability of a flattened swing arc is developed in the ball contact zone. In other words, too steep a swing arc will cause the golf club head 16 to strike the ends 54 of pendulum members 52. The golfer is, thus, required to make the club head move through a proper swing path in order to avoid engaging the row of pendulums 52.

It should further be noted that if upright member 18 is adjustably mountable on base 20, the position of arm 26 can be reversed, thus enabling the training aid devices of the present invention to accommodate both right and left-handed golfers.

It will further be appreciated that the device of the present invention enables an average golfer to practice with the device without golf balls in his own backyard. Additionally, if desired, the device can be used in connection with a golf ball placed on supporting surface 20, if desired. Thus, the device can, if desired, be taken to a driving range and utilized there in conjunction with golf balls. In such event it may be desirable to provide a carpeted surface on support base 20 in order to provide an environment which simulates the conditions found on a golf course to the extent possible.

In addition to the foregoing specified embodiments, it will be apparent to those skilled in the art that further modifications and adaptations can be made. The foregoing specific embodiments therefore should be viewed as being illustrative and all modifications falling within the meaning and equivalency range of the appended claims are intended to be embraced therein.

What is claimed is:

1. A golf swing practice device for assisting a golfer in the development of a correct golf swing comprising a flat support base, an upright supporting member extending upwardly from a surface of said base, a bracket mounted on said upright member, said bracket being mounted thereon by mounting means for vertically adjusting the height of said bracket on said upright member an arm extending laterally and being mounted on said bracket by mounting means for angularly adjusting an orientation of said arm on said bracket relative to the horizontal orientation, a plurality of pendulum members suspended on said arm adjacent to said support base to define a desired correct swing path for said golfer between said pendulum members and said support base.

2. A device according to claim 1 wherein said pendulum members formed from a molded plastic.

3. A device according to claim 1 wherein an elongated element is suspended on said arm between said pendulum member and said upright support to define a desired maximum extension of the clubhead away from the golfer in the swing path.

4. A device according to claim 1 wherein each of said pendulum members has a spherical lower extremity, each of said pendulum members being adjacent to said support base to define a desired correct swing path conforming to the shape of a clubhead.

5. A device according to claim 4 wherein each of said pendulum members has an upper end with an eyelet for suspending said pendulum member on said arm in a free-swinging manner.

6. A device according to claim 1 wherein the lower extremity of each of said pendulum members is in the shape of an elongated rod each such rod being oriented generally parallel to the support surface thereby defining a correct swing arc of extended length adjacent to said support surface.

7. A device according to claim 1 wherein said upright member is in the form of a hollow elongated shape having a slot on at least one side and said bracket is slidably received in said slot.

* * * * *